US007703605B2

(12) United States Patent
Tommassini

(10) Patent No.: US 7,703,605 B2
(45) Date of Patent: Apr. 27, 2010

(54) ROUTER BIT CASE

(75) Inventor: Marcello Tommassini, Pesaro (IT)

(73) Assignee: C.M.T. Utensili S.p.A., Pesaro (IT)

( * ) Notice: Subject to any disclaimer, the term of this patent is extended or adjusted under 35 U.S.C. 154(b) by 202 days.

(21) Appl. No.: 11/506,956

(22) Filed: Aug. 18, 2006

(65) Prior Publication Data

US 2008/0041753 A1 Feb. 21, 2008

(51) Int. Cl.
*B65D 85/28* (2006.01)

(52) U.S. Cl. ..... 206/372; 206/373

(58) Field of Classification Search ..... 206/372, 206/377, 378, 523, 486, 562, 563, 564, 373, 206/45.24
See application file for complete search history.

(56) References Cited

U.S. PATENT DOCUMENTS 3,642,123 A * 2/1972 Knox ..... 206/365
3,804,238 A 4/1974 Howard
4,244,469 A 1/1981 Miner
4,598,822 A 7/1986 Hemmings
5,098,235 A 3/1992 Svetlik et al.
D343,063 S * 1/1994 Chen ..... D3/282
D372,582 S * 8/1996 Beaty et al. ..... D3/313
5,813,532 A 9/1998 Kheradpir et al.
5,826,719 A * 10/1998 Chen ..... 206/373
5,951,385 A 9/1999 Newhouse et al.
6,039,197 A * 3/2000 Braun ..... 215/228
6,260,701 B1 7/2001 Katayama et al.
D474,020 S * 5/2003 Wang et al. ..... D3/274

OTHER PUBLICATIONS

CMT Sommerfeld Junior Raised Panel Set (CMT#800.522.11), Wood Tech Enterprises, Inc. [online], Feb. 2003 [retrieved on Aug. 1, 2008]. Retrieved from the Web: <http://web.archive.org/web/20030205150307/http://woodtechtooling.com/>.*
ITW Fastex, Push to Latch, Ball & Catch, accessed Friday, Dec. 4, 2009 @ 10:15 AM. http://www.itw-fastex.com/catalog/index.php/dw/op/a/1/c/31/p/77?m=no.*

* cited by examiner

*Primary Examiner*—Ehud Gartenberg
*Assistant Examiner*—Ernesto A Grano
(74) *Attorney, Agent, or Firm*—Frommer Lawrence & Haug LLP; Paul A. Levy

(57) ABSTRACT

A router bit case that includes a bottom half that having a plurality of router bit-shaped recesses with a substantially flat bottom surface that includes a sloped portion and a deepened cavity. The router bit case also includes a top half having a plurality of recesses formed therein, a plurality of hinges and a closing device.

7 Claims, 8 Drawing Sheets

ROUTER BIT CASE

BACKGROUND OF THE INVENTION

1. Field of the Invention

The instant invention relates generally to a case or housing that may be used to store router bits. More particularly, the instant invention relates to a router bit case having recessed router bit compartments with a sloped bottom portion that corresponds to the bottom end of a router bit's shank.

2. Background of the Invention

Typically, machine bits such as router and drill bits are stored in plastic, metal or wooden cases or housings. With respect to router bits, these cases usually come in two varieties. One type of case contains recessed portions in the shape of the bit profile into which the router bits are placed and held. In this type of case or housing, the shank portions of the bit are usually recessed below the surface of the case making it difficult for a user to remove the bit without grabbing the body portion of the bit that contains the sharpened cutting blades. Another type of router bit case contains holes into which the shank portions of the router bits are placed. In this type of case, the body portion of the bit remains exposed making it an obvious choice for a user to grasp in order to remove the desired bit.

With both types of prior art cases, the router bits are usually held in place by some type of retaining means or by frictional forces. Therefore, a user removing a router bit from either of the two conventional router bit cases or housings is required to exert a force in order to remove the bit. Because the body portions of the router bit are usually the only portions of a router bit that remain exposed while the bits are stored in a case, a user is forced to grasp the body portions that contain the cutting blades to forcibly remove the bits from the case. This, however, places a user at high risk of injuring himself or herself on the sharpened cutting blades.

Accordingly, a need exists to provide an alternative to current router bit storage means that is safer than those that exist in the art.

SUMMARY OF THE INVENTION

It is therefore a principal object of the invention to provide a router bit case that allows a user to safely remove a router bit from the case.

It is a further object of the invention to provide a router bit case where a user can remove a router bit by simply pressing on the bottom end of a router bit shank.

Yet another object of the invention is to provide a router bit case that can be easily opened by inserting a coin or similar object within a recess formed at the front of the case in the top surface of the bottom half.

A still further object of the invention is to provide a router bit case that is machined out of a solid block of material such as wood or plastic.

These and other objects and advantages are provided by the instant invention. In this regard, the instant invention is directed to a router bit case. The instant router bit case comprises a bottom half that has a plurality of router bit-shaped recesses formed therein. These router bit-shaped recesses have a substantially flat bottom surface that includes a sloped portion and a deepened cavity at the bottom end of the recess. The router bit case also comprises a top half that has a plurality of recesses formed therein in order to receive the body of the router bits when the case is in a closed position. A plurality of hinges disposed along the back end of the router bit case, join the top and bottom halves together. In order to keep the router bit case in a closed condition, a closing means is provided between the top and bottom halves of the case. Lastly, to facilitate opening of the router bit case, an additional recess is provided at the front of the case on the top surface of the bottom half of the case. Preferably, this additional recess is semicircular-shaped in order to allow a coin or similar object to be inserted therein and twisted, thereby opening the case.

The various features of novelty which characterize the invention are pointed out in particularity in the claims annexed to and forming a part of this disclosure. For a better understanding of the invention, its operating advantages and specific objects attained by its uses, reference is made to the accompanying descriptive matter in which preferred embodiments of the invention are illustrated in the accompanying drawings in which corresponding components are identified by the same reference numerals.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE PREFERRED EMBODIMENTS

Figure 1:
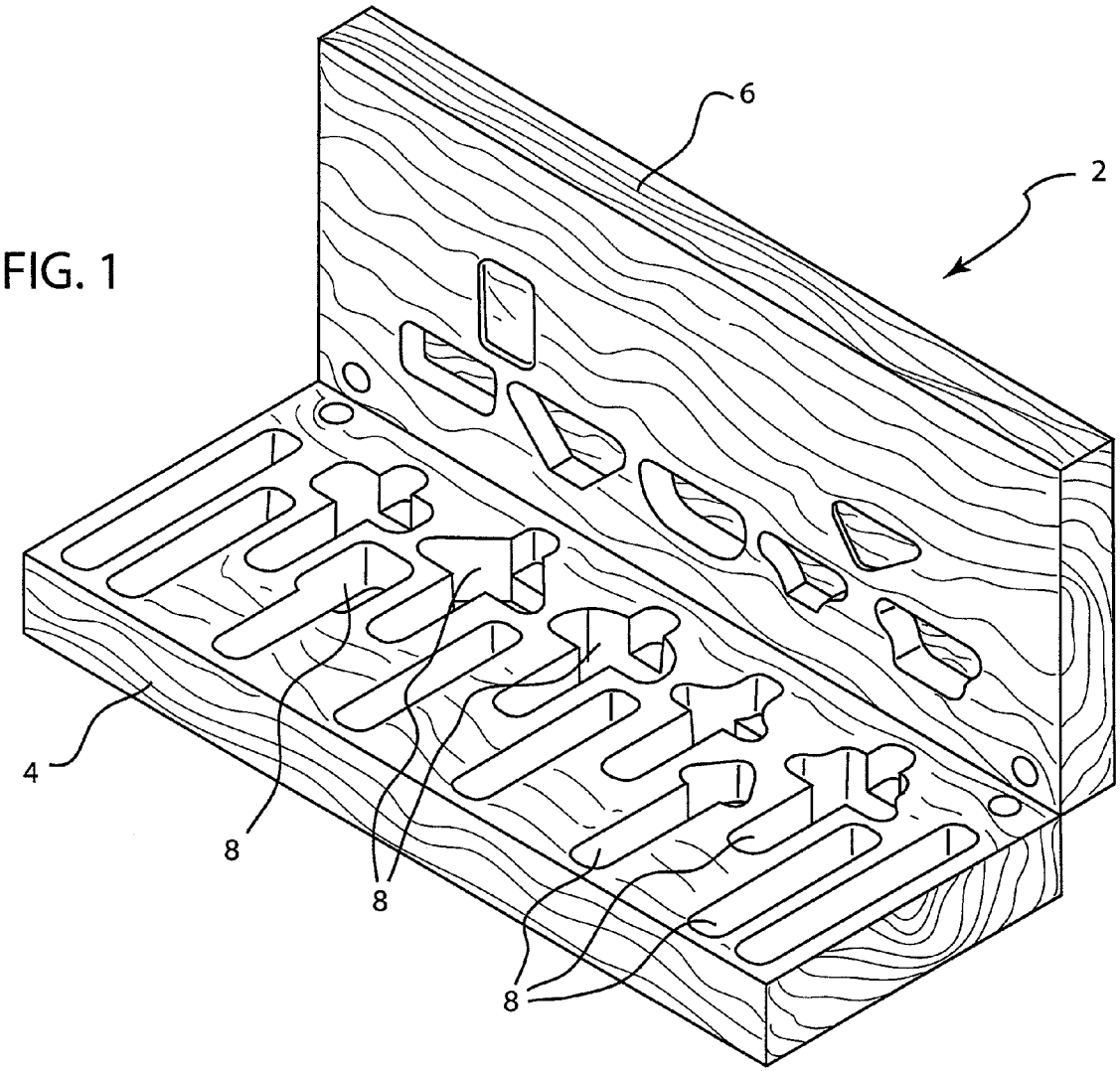
FIG. 1 is a perspective view of a router bit case, according to one embodiment of the instant invention.

The instant invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

In the following description, like reference characters designate like or corresponding parts throughout the figures. Additionally, in the following description, it is understood that terms such as "upper," "lower," "top," "bottom," and the like are words of convenience and are not to be construed as limiting terms.

Figure 2:
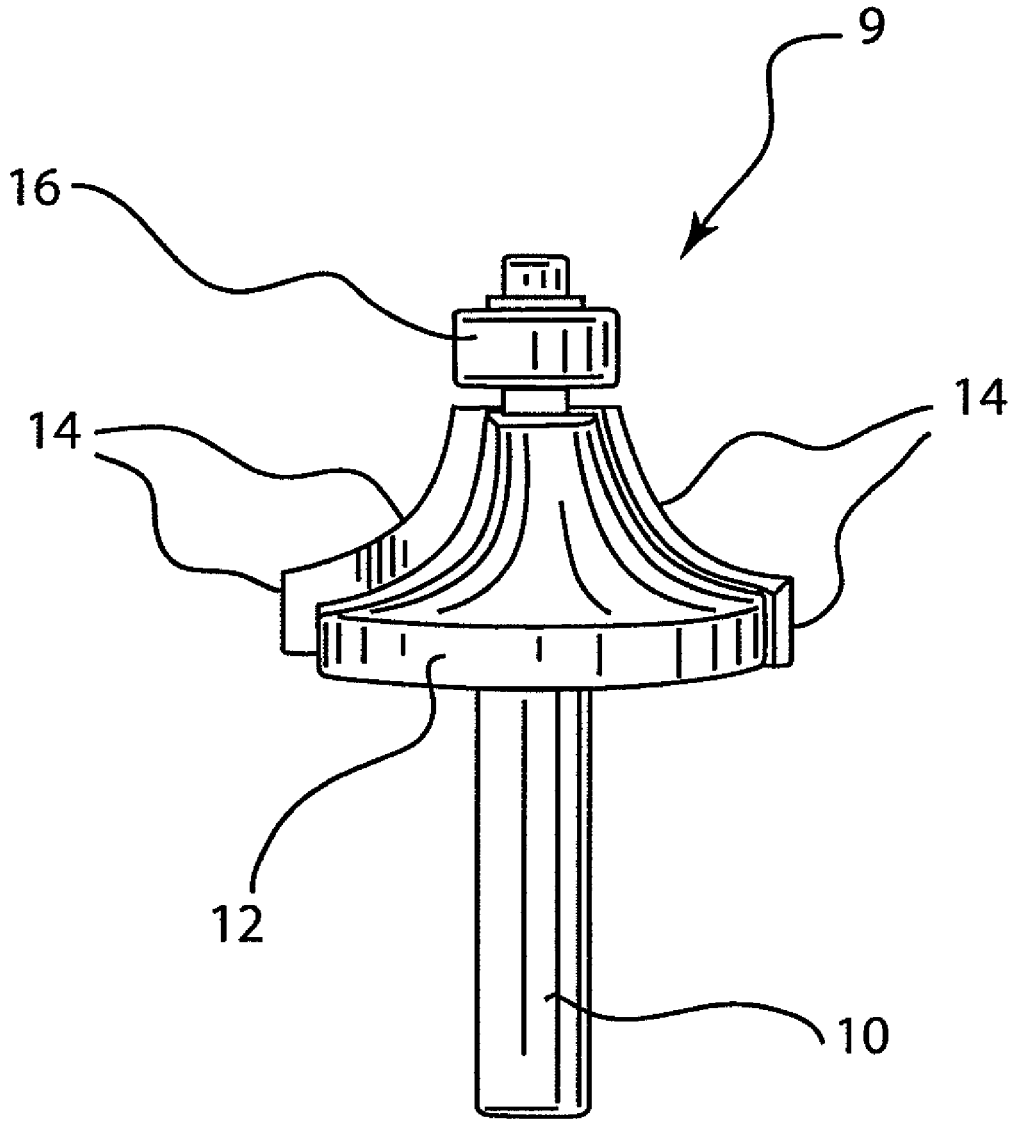
FIG. 2 is a side elevation view of a router bit.

Referring now to the figures, FIG. 1 depicts a router bit storage case or housing 2 according to one embodiment of the instant invention. The router bit case 2 comprises a lower or bottom portion or half 4 and an upper or top portion or half 6. Machined in the bottom half 4 are recesses 8 in the profile of each specific router bit that is to be stored in the case 2. As depicted in FIG. 2, router bits 9 typically comprise a shank 10 and a body 12. Attached to the body 12 are cutting blades 14. Additionally, a router bit 9 may include a bearing 16.

Figure 3:
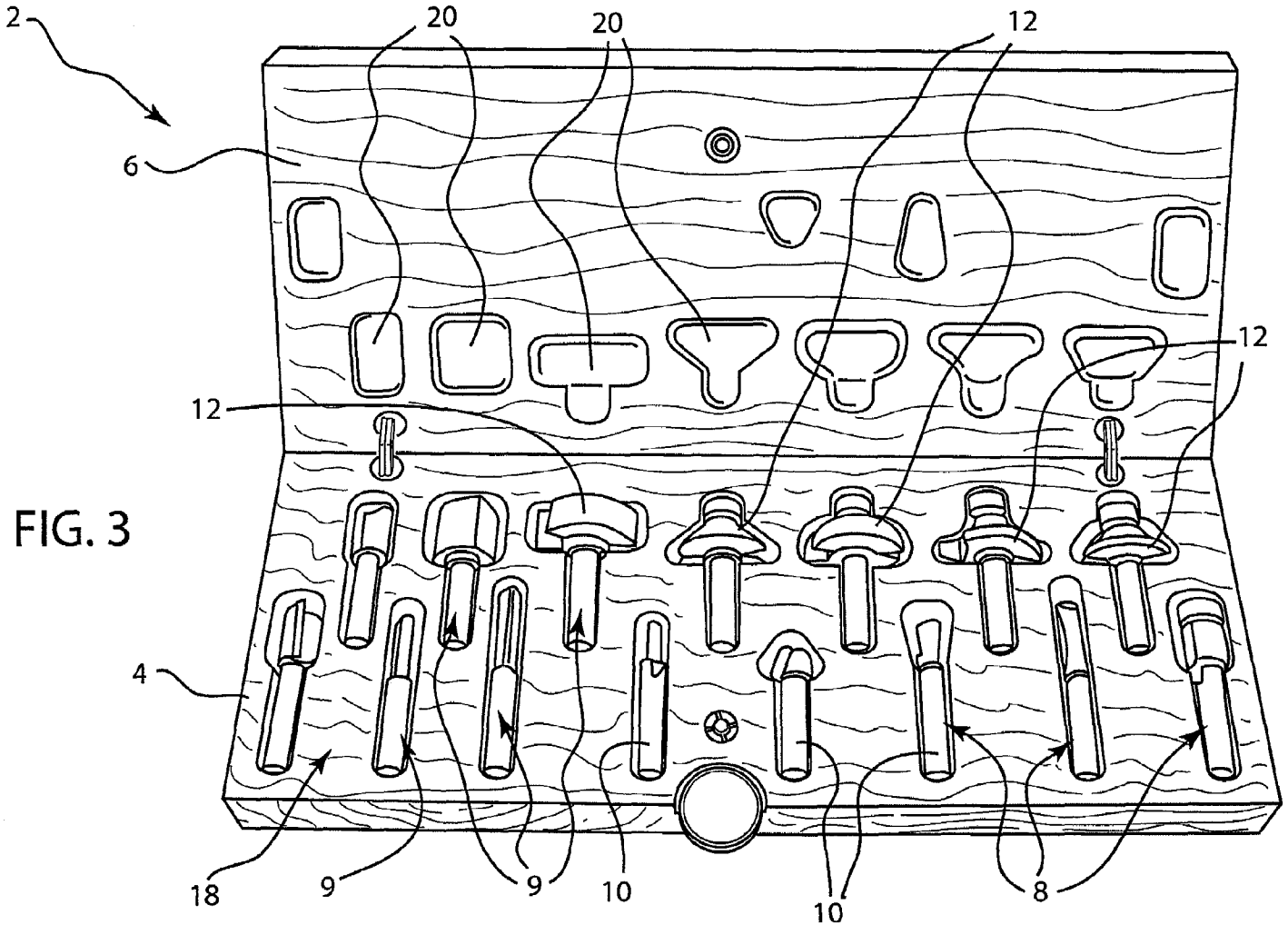
FIG. 3 is a plan view of a router bit case, according to one embodiment of the instant invention.

As shown in FIGS. 1 and 3, the recesses 8 are formed so that the router bits 9 are within the bottom half 4 of the case 2 such that the shank 10 of the router bits 9 are disposed beneath the surface 18 of the bottom half 4. As can further be seen in FIG. 3, the body 12 of many of the router bits 9 remain exposed or protrude above the top surface 18 of the bottom half 4. Because of the protruding body 12 of some of the router bits 9, the top half 6 of the router bit case 2 must be machined to include recesses 20. Because the recesses, 8 and 20, are machined into solid blocks of material that form the top and bottom of the router bit case, the case is essentially comprised of two solid pieces of material that form a shell that surrounds the router bits. Therefore, the instant router bit case is more durable than prior cases.

Figure 4:
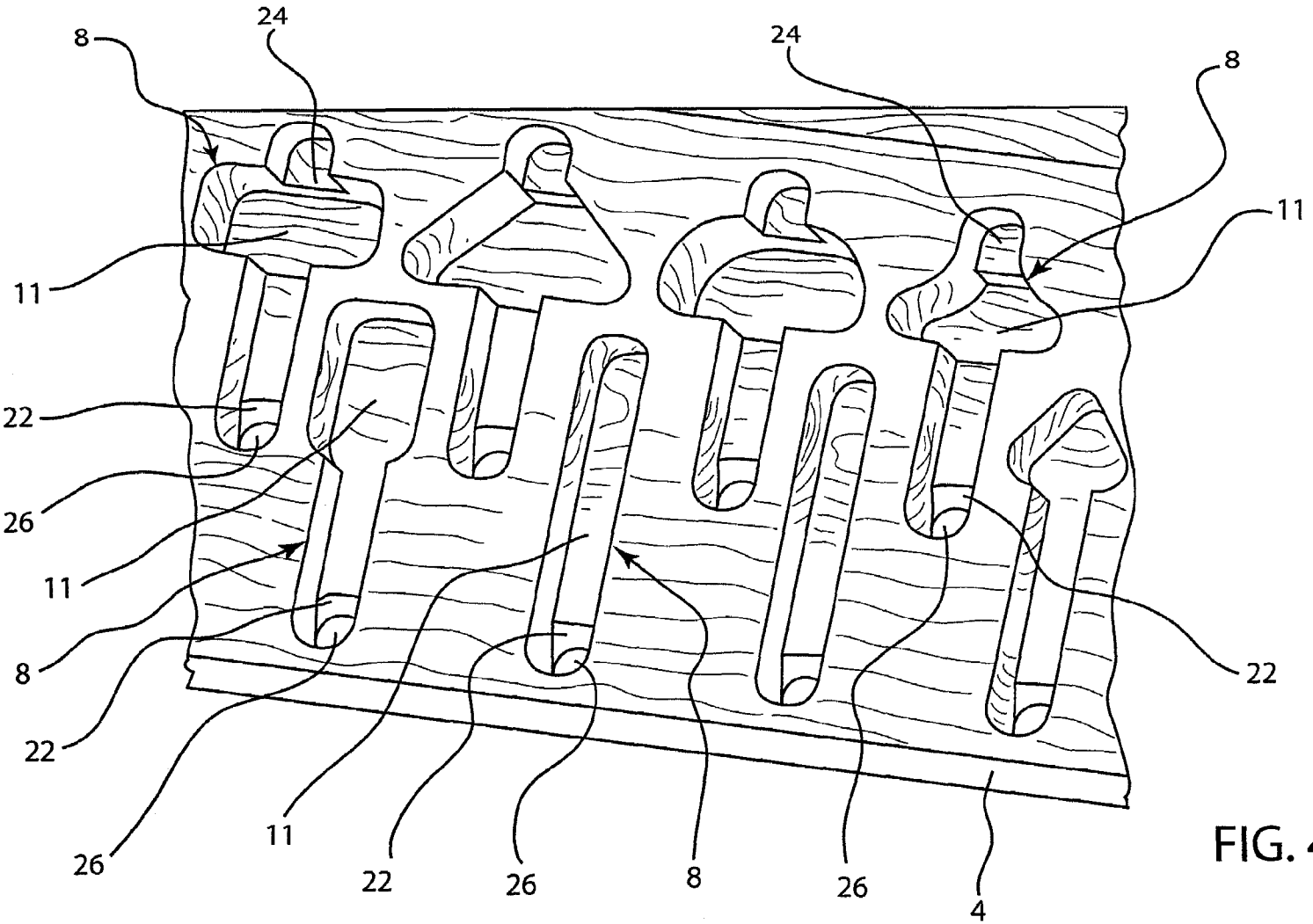
FIG. 4 is a magnified view of the bit-shaped recesses formed in the bottom half of the router bit case, according to one embodiment of the instant invention.

Illustrated in FIG. 4 is a magnified view of the router bit recesses 8 formed in the bottom half 4 of the router bit case 2. As can be seen in the figure, the bottom surfaces 11 of the recesses 8 are substantially flat except for a sloped portion 22 at the bottom region of the recesses 8 where the shank of the router bit is disposed and for a shelf of material 24 in the top region of some of the recess 8 that supports the bearings 16. This sloped portion 22 slopes down from the substantially flat bottom surface 11 of the recess 8 to a deepened cavity 26 at the bottom-most region of the recess 8. As described below, inclusion of the sloped portion 22 and deepened cavity 26 allow a user to safely and more easily remove a router bit from the router bit case.

Having the bit recess 8 machined in the specific profile of each router bit that is to be stored in the case in combination with the sloped portion 22 is advantageous and safer over the prior art cases because it prevents a user from inadvertently placing a router bit in the wrong recess. Because each router bit in the instant case will be stored in the correct recess, the bottom portion of the shank will always be in the region of the recess 8 that contains the sloped portion 22. Therefore, when a user depresses the bottom portion of the router bit shank, the sloped portion 22 prevents the router bit from rotating up too quickly or too much and results in the router bit being raised out of the bottom half of the router case substantially the same amount each time.

This is not the case with prior cases. For example, U.S. Pat. No. 3,804,238 (the "'238 patent") is directed to a display case for sabre saw blades. The '238 patent discloses a deepened well that aids in the removal of the sabre saw blades. The compartments in the case, however, are not designed to hold specific sized sabre saw blades. That is, different sized blades can be placed in the same compartment. Furthermore, unlike in the instant invention that has a sloped surface that slopes down from the substantially flat bottom surface of each recess to the deepened cavity, the depth change in the '238 patent from the bottom of the compartments to the deepened well is abrupt. The combination of not having compartments constructed to receive specific sabre saw blades and the abrupt change in depth from the bottom or each compartment to the deepened well, may result in a shorter sabre saw blade that has its end portion positioned at the point where the depth of the case abruptly drops down to the deepened well, to flip or rotate out of the case toward the user when a user presses down on the end portion of the blade, thereby potentially injuring the user.

Figure 5:
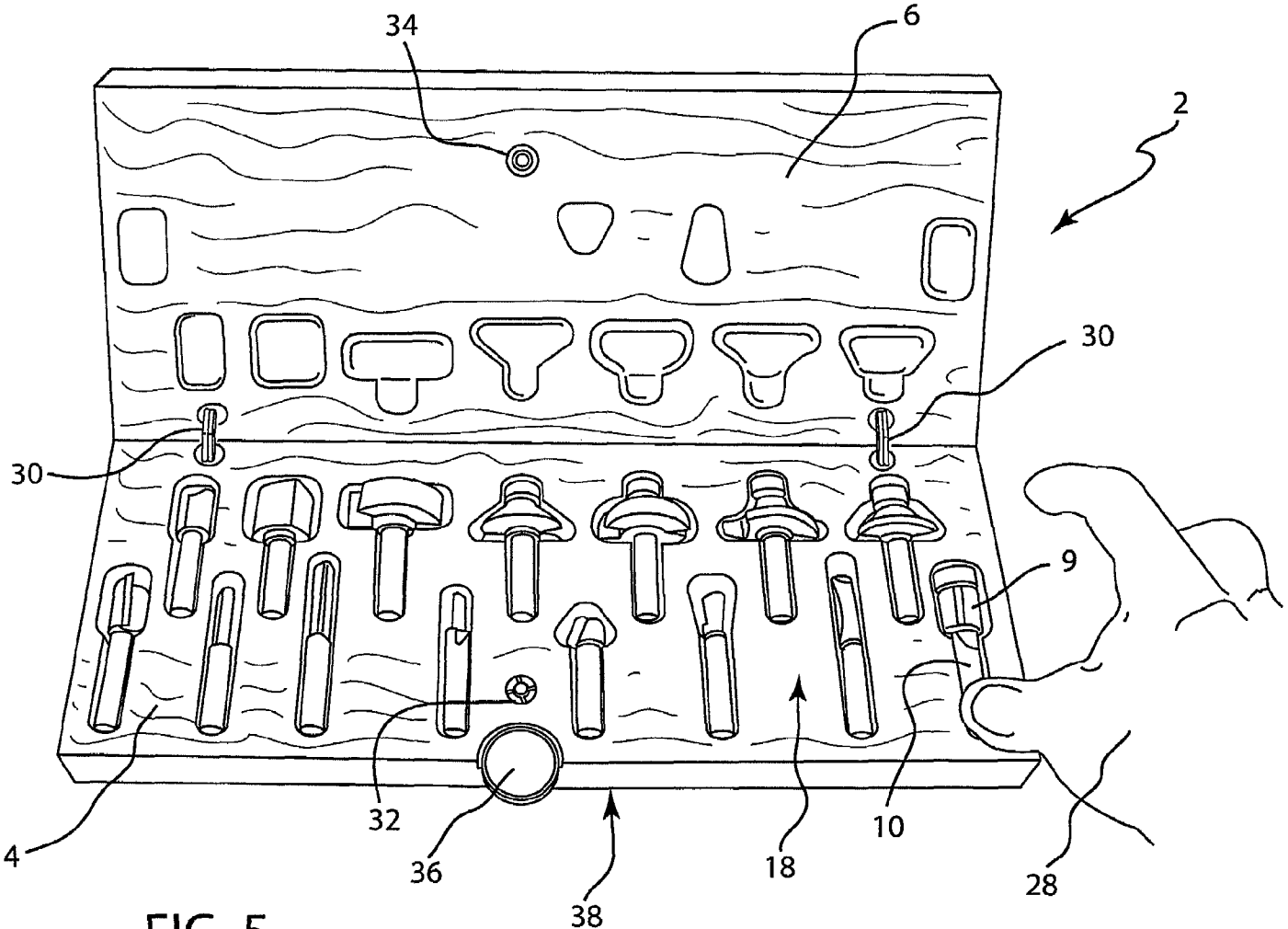
FIG. 5 is a plan view of a router bit case illustrating a router bit removal method, according to one embodiment of the instant invention.

FIG. 5 shows that the instant router bit case 2 further includes a plurality of hinges 30, a two-part closing means comprised of a first part 32 in the bottom half 4 of the case 2 and a second part 34 in the top half 6 of the case 2. In the instant embodiment, the two-part closing mechanism is a ball and catch type mechanism where the catch portion is disposed in the bottom half 4 and the ball portion is disposed in the top half 6 of the case. When the case is closed by bringing the top half 6 into contact with the bottom half 4, the ball portion snappingly engages the catch portion to hold the case 2 in a closed position. As will be apparent to those skilled in the art, any closing mechanism that holds the case in a closed condition and subsequently allows the case to be opened, may be used.

Figure 7:
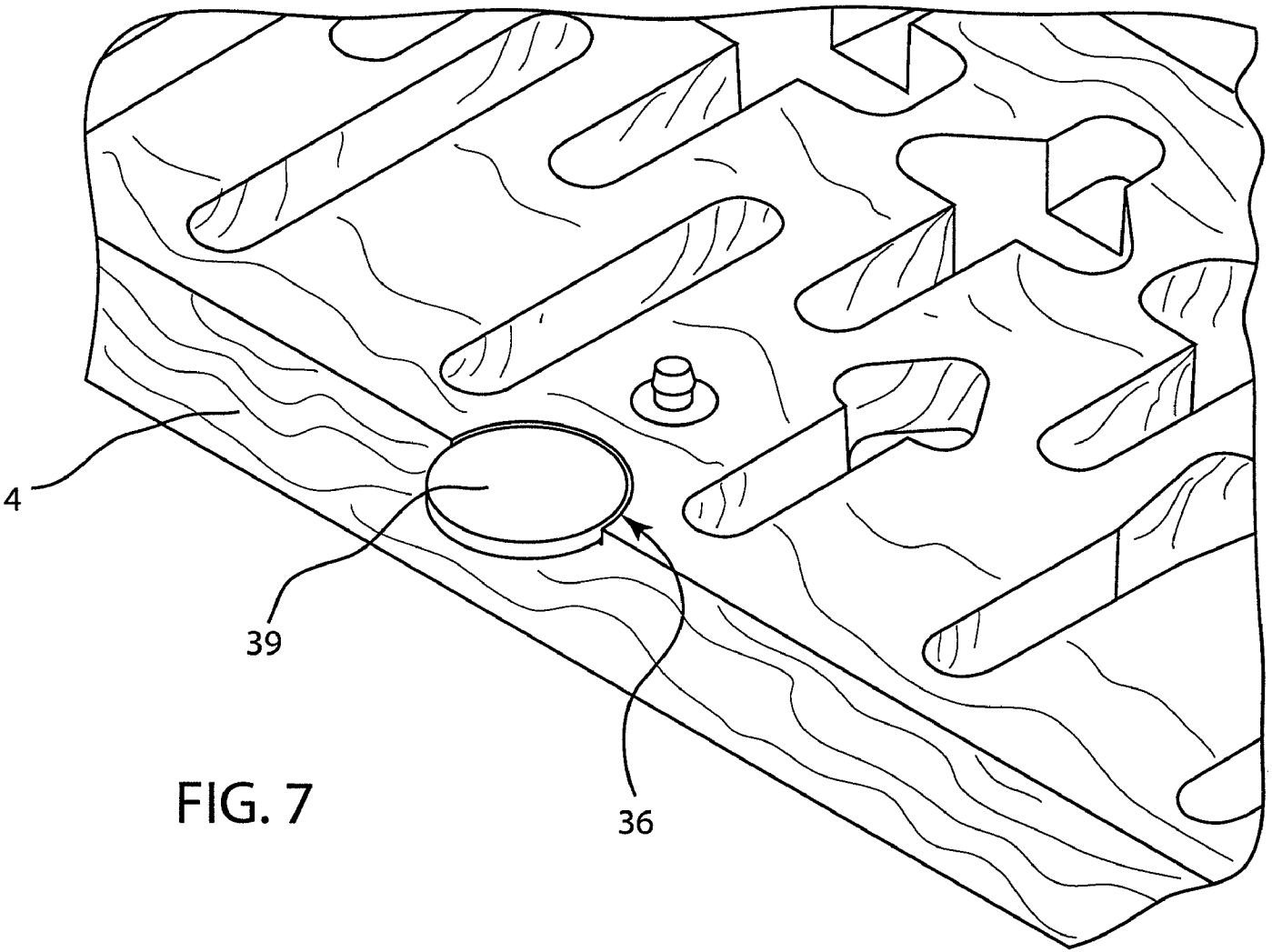
FIG. 7 is a magnified perspective view of the front of the bottom half of the router bit case, according to one embodiment of the instant invention.
Figure 8:
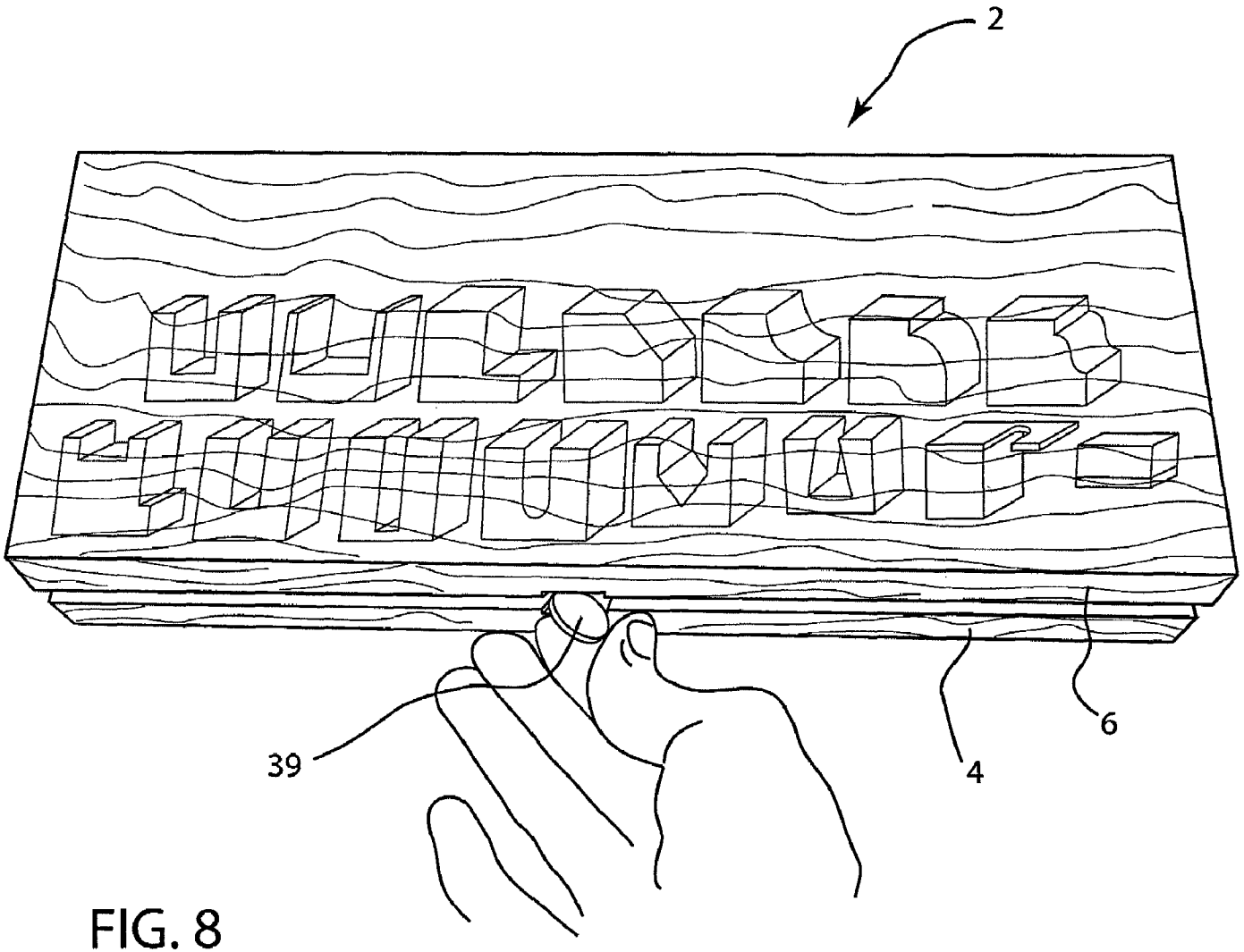
FIG. 8 is a plan view of a router bit case illustrating the case opening method, according to one embodiment of the instant invention.

Lastly, as shown in FIG. 5, the bottom half 4 of the case 2 also includes a recessed portion 36 in the bottom surface 18 at the front 38 of the case 2. As shown in FIG. 5, recessed portion 36 in the instant embodiment is semi-circular-shaped. As depicted in FIGS. 7 and 8, the semi-circular recessed portion 36 of the instant embodiment allows an object, such as, for example a coin (a quarter) 39 to be inserted between the bottom half 4 and the top half 6 of the case 2 and twisted in order to unsnap or separate the two-part closing mechanism thereby opening the case. The depth of the recess 36 should be equal to at least the thickness of a coin (a quarter) in order to allow the coin to be inserted between the two halves of the case 2. As will be apparent to those skilled in the art, additional objects, such as, but not limited to screwdrivers, may also be inserted semi-circular recessed portion 36 in order to open the router bit case 2. In addition, as will be apparent to those skilled in the art, the semi-circular recessed portion 36 may be any shape that allows an object to be inserted between the two halves of the case in order to open the case.

Figure 6:
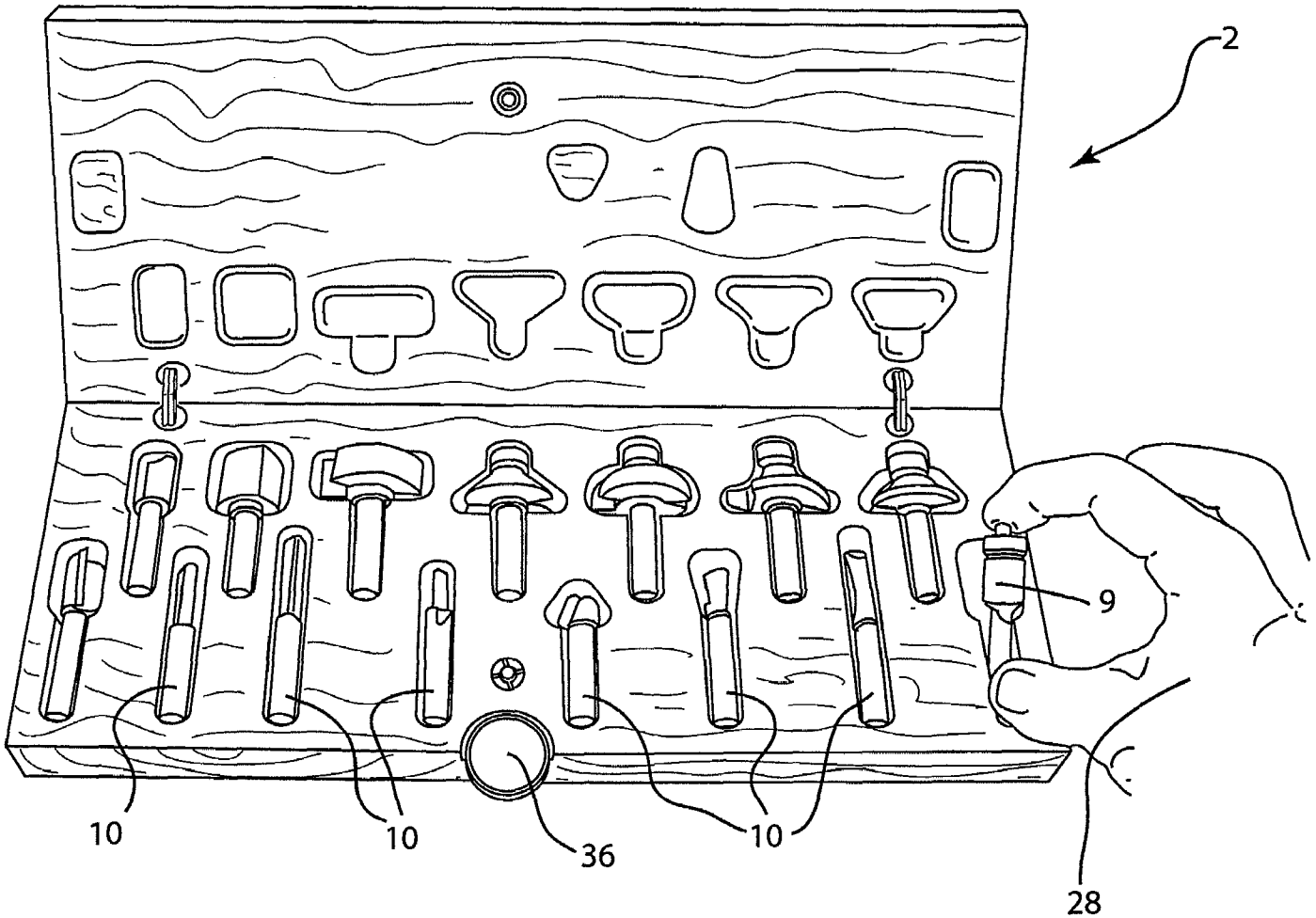
FIG. 6 is a plan view of a router bit case illustrating a router bit removal method, according to one embodiment of the instant invention.

Removal of a router bit from the instant router bit case will now be described. As depicted in FIG. 5, to remove a router bit 9, a user 28 positions a finger over the bottom portion of the shank 10. Next, the user 28 presses down on the bottom portion of the shank 10 causing the bottom of the shank 10 to be depressed into the deepened cavity 26 of the router bit recess 8. This results in the router bit 9 pivoting around the sloped portion 22 so that the body 12 of the router bit 9 rotates up and out of the recess 8. As shown in FIG. 6, now with a majority of the router bit 9 exposed, a user 28 may simply and safely remove the router bit 9 from the case 2 by grasping any of the exposed portions of the router bit 9 that do not include the cutting blades.

Preferably, the instant router bit case 2 is constructed out of wood or wood material, however, any material that can be machined to include the necessary router bit recesses 8 and the semi-circular recess 36, such as, but not limited to plastic or a plastic material, may be used.

Although a preferred embodiment of the present invention and modifications thereof have been described in detail herein, it is to be understood that this invention is not limited to this precise embodiment and modifications, and that other modifications and variations may be effected by one skilled in the art without departing from the spirit and scope of the invention as defined by the appended claims.

What is claimed is:

1. A router bit case comprising:

a plurality of router bits;

a bottom half case that comprises a plurality of router bits-shaped recesses, the bits-shaped recesses shaped to receive a respective one of said plurality of router bits and having a substantially flat bottom surface, the flat bottom surface having a sloped portion and a deepened cavity such that a router bit disposed in the recess has a portion of a shank resting on the flat bottom surface and a portion of the shank being over and not resting on the sloped portion and the deepened cavity;

a top half case having a plurality of top recesses formed therein, each top recess corresponding to a respective router bits-shaped recess;

a plurality of hinges;

a two-part closing mechanism, wherein said first part is a ball-type structure disposed in said top half case and a second part is a catch-type structure in said bottom half case that is complementary in shape to said ball-type structure in order to receive said ball-type structure within said catch-type structure; and a semi-circular-shaped recess disposed in a top surface of said bottom half case at an end of said bottom half opposite to said plurality of hinges.

2. The router bit case as claimed in claim 1, wherein said semi-circular-shaped recess is shaped to receive a coin therein.

3. The router bit case as claimed in claim 1, wherein said bottom half case and said top half case are constructed from wood or a wood material.

4. The router bit case as claimed in claim 1, wherein said bottom half case and said top half case are constructed out of plastic or a plastic material.

5. The router bit case as claimed in claim 1, wherein said router bit shaped recesses comprise a router bit body portion and a router bit shank portion.

6. The router bit case as claimed in claim 5, wherein said sloped portion and said deepened cavity are in said router bit shank portion of said router bits-shaped recesses.

7. The router bit case as claimed in claim 1, wherein said router bit-shaped recesses are machined into a top surface of said bottom half case.

* * * * *